US005530522A

United States Patent [19]

Tsunemi

[11] Patent Number: 5,530,522

[45] Date of Patent: Jun. 25, 1996

[54] IMAGE FORMING APPARATUS WITH CONTROLLED TRANSFER VOLTAGE

[75] Inventor: Takeo Tsunemi, Kawasaki, Japan

[73] Assignee: Canon Kabushiki Kaisha, Tokyo, Japan

[21] Appl. No.: 411,155

[22] Filed: Mar. 27, 1995

[30] Foreign Application Priority Data

Mar. 26, 1994 [JP] Japan ..... 6-079765

[51] Int. Cl.[6] ..... G03G 15/00; G03G 15/16

[52] U.S. Cl. ..... 355/208; 355/273

[58] Field of Search ..... 355/208, 271, 355/273, 274, 311

[56] References Cited

U.S. PATENT DOCUMENTS 5,081,501 1/1992 Waki et al. .
5,179,397 1/1993 Ohzeki et al. .

FOREIGN PATENT DOCUMENTS 367245 5/1990 European Pat. Off. .
5-46030 2/1993 Japan ..... 355/274
6-266243 9/1994 Japan ..... 355/274

*Primary Examiner*—Joan H. Pendegrass
*Attorney, Agent, or Firm*—Fitzpatrick, Cella, Harper & Scinto

[57] ABSTRACT

An image forming apparatus includes a movable image bearing member; an image transfer member cooperative with the image bearing member to form a nip where an image is transferred from the image bearing member onto a transfer material, wherein the transfer member is constant-voltage-controlled during image transfer operation; wherein a voltage applied to the transfer member during constant voltage control is determined in accordance with a dimension of the transfer material measured in a direction perpendicular to a movement direction of the image bearing member.

12 Claims, 7 Drawing Sheets

IMAGE FORMING APPARATUS WITH CONTROLLED TRANSFER VOLTAGE

FIELD OF THE INVENTION AND RELATED ART

The present invention relates to an image forming apparatus such as an electrophotographic machine or electrostatic recording machine.

An image forming apparatus such as an image transfer type copying machine, printer or the like is known in which a transferable image (toner image) is formed on an image bearing member such as a photosensitive member, dielectric member, magnetic member through an image forming process such as an electrophotographic process, an electrostatic recording process, a magnetic recording process, corresponding to image information intended. The toner image is electrostatically transferred onto a sheet-like transfer material. The toner image is then fixed into a permanent image. As a means for electrostatically transferring the toner onto the transfer material from the image bearing member in such an apparatus, electroconductive elastic transfer roller, transfer belt or another transfer means is contacted to the image bearing member to form a nip, into which a transfer material is supplied at the timing to be aligned with the toner image on the image bearing member, and the transfer means is supplied with a transfer bias voltage, by which the toner image is electrostatically transferred onto the transfer material (contact type electrostatic transfer means).

FIG. 8 shows an example of such a contact type electrostatic transfer means.

In this Figure, designated by a reference numeral 1 is an image bearing member, more particularly, a rotatable electrophotographic photosensitive drum, for example. It comprises a drum base 1*b* of electroconductive material such as aluminum, and a photosensitive layer 1*a* thereon.

An elastic transfer roller 2 is of electroconductive rubber and functions as the transfer means. It extends substantially parallel with the image bearing member at a predetermined pressure. It is supplied with a voltage from a transfer bias voltage source 4.

The image bearing member 1 is rotated in the clockwise direction indicated by an arrow, and a toner image as the transferable image is formed thereon corresponding to the intended image information by unshown image formation process means disposed around the image bearing member.

On the other hand, a transfer material P is supplied from an unshown sheet feeding station and is fed to a transfer nip N between the image bearing member and the transfer roller through a passage 3, at such a timing that when the leading edge of the toner image on the image bearing member reaches the transfer nip N, the leading edge of the transfer material reaches the transfer nip N. The transfer roller 2 is supplied with a transfer bias voltage from the voltage source 4, and the toner image is sequentially transferred from the image bearing member 1 onto the transfer material P by the electric field provided by the applied bias voltage.

Such a transfer means is advantageous over a non-contact type corona discharging means in which a transfer corona charger is disposed close to the image bearing member, and the transfer material is passed through the gap therebetween, wherein the transfer corona charger is supplied with a transfer bias to produce corona discharge which is effective to transfer the image. The reasons are that the backside of the transfer material is not liable to receive excessive charge and that the toner scattering around the edge of characters hardly occurs therefore.

Additionally, the transfer material P is gripped by the image bearing member 1 and the transfer roller 2 at the transfer nip N, and therefore, the transfer deviation which otherwise occur due to the shock at the time of entrance and discharge of the transfer material to and from feeding means and fixing position before and after the transfer nip N, and therefore, the image quality is high.

Furthermore, since corona wire or electrode are not used, and therefore, the problem arising from contaminations thereof do not exist, When the transfer roller 2 is subjected to constant current control during the transfer operation, the following problem arise.

In such an image forming apparatus, it is usual that a transfer material smaller than the maximum usable size of the apparatus can be used, too. When the small size transfer material is used, nonsheet passage area in which the transfer material does not exist and therefore the transfer roller is directly contacted to the photosensitive member, occurs in the longitudinal direction of the photosensitive member, even during the passage of the transfer material through the nip. The electric current easily flows through the non-sheet-passage portion than the sheet passage portion, and therefore, the voltage applied to the transfer roller 2 lowers with the result of insufficiency of the current in the sheet-passage region, and therefore, of the improper image transfer.

As a means for solving this problem, ATVC system (active transfer voltage control) has been proposed as disclosed in EPA-367245.

The ATVC system will be briefly described, referring to FIG. 9. Before the transfer material P reaches the transfer nip N, a constant current control through the transfer roller 2 is effected with the current I1, and the voltage produced is stored, When the transfer material P reaches the transfer position N, the constant voltage control is effected for the transfer roller 2 with the voltage level thus stored.

U.S. Pat. No. 579397, discloses that the constant voltage control is effected with the stored voltage multiplied by a coefficient R. By selecting the coefficient R, optimum transfer current is provided.

With such control method, the following problem arises.

In such an image forming apparatus, it is usual that a transfer material smaller than the maximum usable size of the apparatus can be used, too. When the small size transfer material is used, nonsheet passage area in which the transfer material does not exist and therefore the transfer roller is directly contacted to the photosensitive member, occurs in the longitudinal direction of the photosensitive member, even during the passage of the transfer material through the nip. The electric current easily flows through the non-sheet-passage portion than the sheet passage portion, and therefore, the voltage applied to the transfer roller 2 lowers with the result of insufficiency of the current in the sheet-passage region, and therefore, of the improper image transfer.

This will be described in more detail referring to FIG. 10. FIG. 10 is a sectional view in which a transfer material P exists between the photosensitive drum 1 and the transfer roller 2. The transfer roller 2 comprises a core metal 2*a* and an electroconductive rubber 2*b*. The paths of the electric currents Ia–Ie at points a–e, are indicated by arrows. In addition, the equivalent circuits from the transfer roller 2 to the photosensitive drum 1 at the point a–e, are also shown.

Here, the resistance of the photosensitive layer of the photosensitive member 1 is RD, the resistance of the transfer material P is RP, the resistance of the transfer roller 2 is RT, and the total resistances at the respective points are Ra–Re.

Adjacent the end portion of the sheet passage region (point b and d), the currents Ib and Id flow not through the transfer material P. At this time, the resistance RT' in the transfer roller rubber 2*b* is larger than RT since the path is longer. However, when the comparison is made between the resistances at points b and c, the currents Ib and Id are as shown in the Figure when RT'<(RP+ RT), since the current flows lower resistance path.

Since the resistance RT' against the current circumventing the transfer material increases toward the inner part from the end of the transfer material, the current through the transfer material is ruling as compared with the current flowing through the nonsheet-passage portion, in the central part of the transfer material. Therefore, the improper image transfer more easily occurs adjacent the end of the transfer material. This phenomenon is more remarkable if the resistance of the transfer roller 2 is lower.

As a countermeasure against this problem, it would be considered that the resistance of the transfer roller 2 is increased. However, control of the resistance is difficult from the standpoint of manufacturing. Additionally, the voltage of the voltage source is required to be increased, with the result of bulkiness and cost increase of the voltage source, and therefore, the insulative property of the apparatus has to be increased.

If the transfer material is thick as in post card, the phenomenon is remarkable.

SUMMARY OF THE INVENTION

Accordingly, it is a principal object of the present invention to provide an image forming apparatus capable of effecting proper image transfer irrespective of the size of the transfer material used.

It is another object of the present invention to provide an image forming apparatus capable of providing optimum transfer current to the transfer material irrespective of the size of the transfer material.

It is a further object of the present invention to provide an image forming apparatus in which a constant voltage control for the transfer member is properly carried out during image transfer operation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

EMBODIMENT 1 (FIGS. 1–3)

Figure 1:
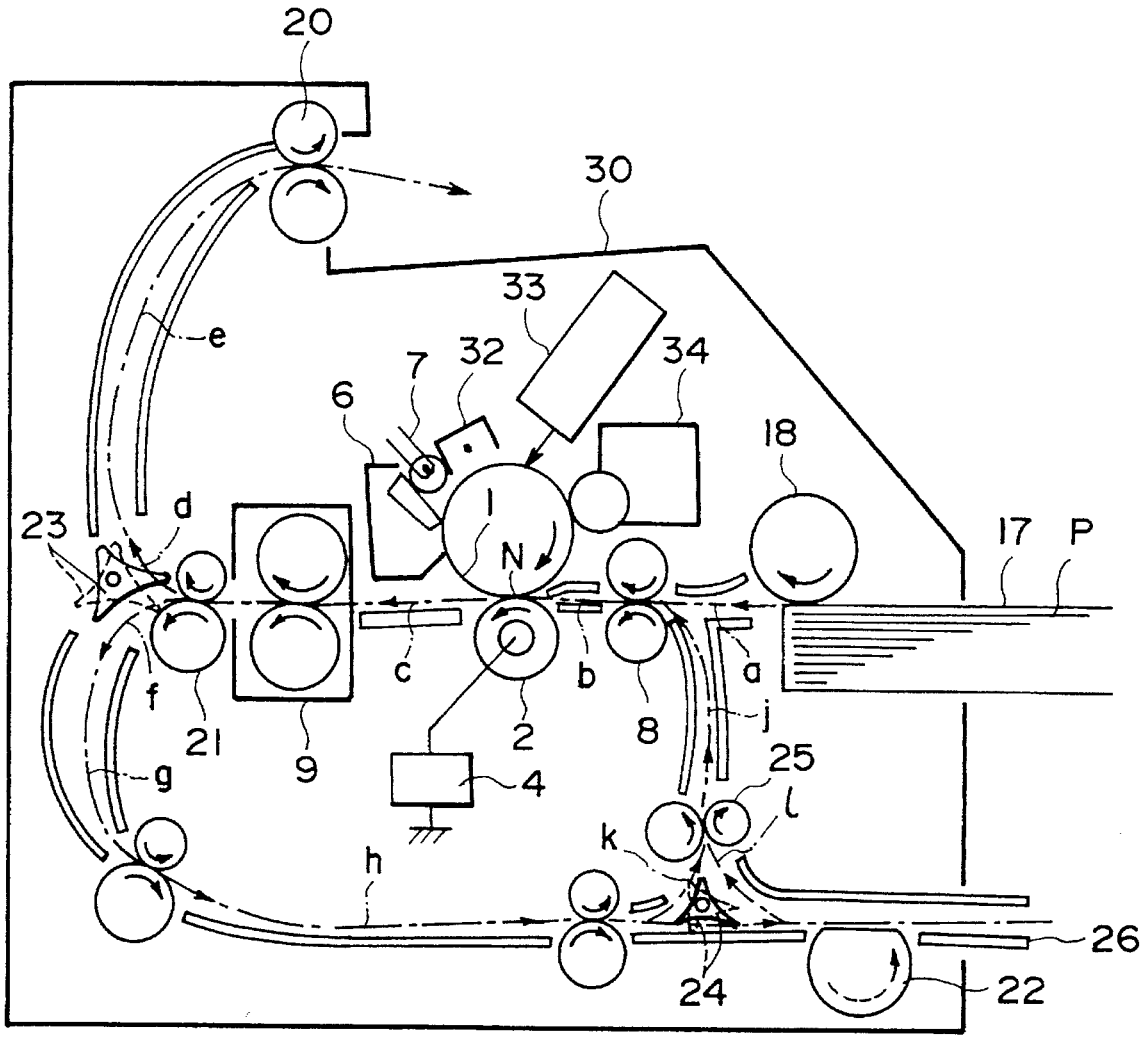
FIG. 1 is a schematic view of an exemplary image forming apparatus.

FIG. 1 schematically illustrates an example of an image forming apparatus, which is a laser beam printer of an image transfer and electrophotographic type. It is capable of forming images on both sides of a transfer material, and of forming superimposed image.

The image bearing member (rotatable drum type photographic photosensitive member) is uniformly charged to a predetermined potential and polarity by a primary charger 32 while it is rotated. The charged surface is exposed to a laser beam modulated in accordance with time series electric digital pixel signal corresponding to intended image information by a laser scanner (light signal applying means) 33, so that an electrostatic latent image corresponding to the intended image information is formed on the surface of the image bearing member 1. A developing device 34 supplies charged toner particles to the latent image, so that the latent image is visualized into a toner image. In this embodiment, the development is a reverse development in which the toner is charged to the same polarity as the polarity of the primary charging.

On the other hand, a transfer material P is fed out from a cassette 17 by a pick-up roller 18 one-by-one, and it is supplied at the predetermined timing to the transfer nip N between the image bearing member 1 and the transfer roller 2 through a sheet passage a, a registration roller 8 and a sheet passage b. The transfer roller 2 is supplied with a transfer bias voltage from a voltage source 4, so that the toner image is transferred onto the transfer material P from the surface of the image bearing member 1.

The transfer material P having received the toner image at the transfer nip N is separated from the surface of the image bearing member 1, and is introduced through a sheet passage f into a fixing device 9, where the toner image is fixed on the transfer material by heat and pressure.

The surface of the image bearing member 1 after the image transfer is cleaned by a cleaning device 6 so that residual toner or other contamination are removed therefrom. It is subjected to electric discharge operation by erasure lamp 7, so that it is usable for the repeated image forming operation.

The apparatus of this embodiment is operable in a simplex printing mode in which the printing is effected only one side of the transfer material, a duplex printing mode in which the printing is effected on both sides of the transfer material P, and a superimposing printing mode in which printing is effected a plurality of times on one side of the transfer material P. The mode is selectable on an operation panel by an operator.

(a) Simplex Printing Mode

The transfer material P discharged from the fixing device 9 is guided to a sheet passage d above a first flapper 23 switched to a first position (broken line), by a pair of discharging rollers 21, and thereafter, the sheet is discharged onto the tray 30 with face down state as a simplex print through a sheet passage e and discharging roller 20.

(b) Duplex Mode

The transfer material P having received the image on a first side and discharged from the fixing device 9 is guided to a sheet passage f below the first flapper 23 changed to the second position indicated by the solid line. Thereafter, the sheet is introduced to an intermediate tray through a sheet passages g and h below the second flapper 24 taking the first position indicated by the solid line. The sheet is once stored on the intermediate tray 36. At the proper timing, the transfer material P is refed by refeeding roller 22 from the intermediate tray 26, and is fed back one-by-one. It is guided through the sheet passage i and a pair of rollers 25, and a sheet passage j. Thereafter, the transfer material is inversed, and refed to the transfer nip N through a pair of registration rollers 8 and a sheet passage b with the second side faced to the image bearing member 1. Then, the toner image is transferred onto the second side.

Subsequently, similarly to the simplex printing mode, the transfer material is discharged on the discharge tray 30 as a duplex print through sheet passage c, the fixing device 9, a pair of feeding rollers 21, the sheet passage d, the sheet passage e, the discharging roller 20.

(c) Superimposing Printing Mode

The transfer material P having been subjected to the first printing operation and discharged from the fixing device 9, is fed through the pair of feeding rollers 21, sheet passages f, g and h, similarly to the duplex printing mode. Subsequently, it is fed through a sheet passage k to the left of the second flapper 24 taking the second position indicated by the broken lines, and is fed to the pair of feeding rollers 25. Similarly to the duplex printing mode, the sheet is refed without inversion to the transfer nip N through the sheet passage j, the registration rollers 8 and the sheet passage b, and the second toner image is transferred to the same side.

Thereafter, through the same passage as in the simplex printing mode, the sheet is discharged on the sheet discharge tray 30 as a superimposed print.

(d) Control

In such an image forming apparatus, the bias voltage applied to the transfer roller is controlled in accordance with the width of the transfer material (the dimension of the transfer material measured in the direction perpendicular to the movement direction of the image bearing member), in the following manner.

Here, the resistance of the transfer roller 2 changes in accordance with ambient condition, and therefore, the relationship between the voltage applied thereto and the current therethrough (V-I characteristic) significantly changes.

More particularly, under the low temperature and low humidity condition (L/L condition, 15° C. and 10%), the resistance of the transfer roller 2 is higher by several orders then that under the normal temperature and normal humidity condition (N/N, 23° C., 64%). On the contrary, under the high temperature and high humidity condition (H/H. 32.5° C. 85%), the resistance of the transfer roller is lower by 1–2 orders as compared with the N/N conditions.

Figure 9:
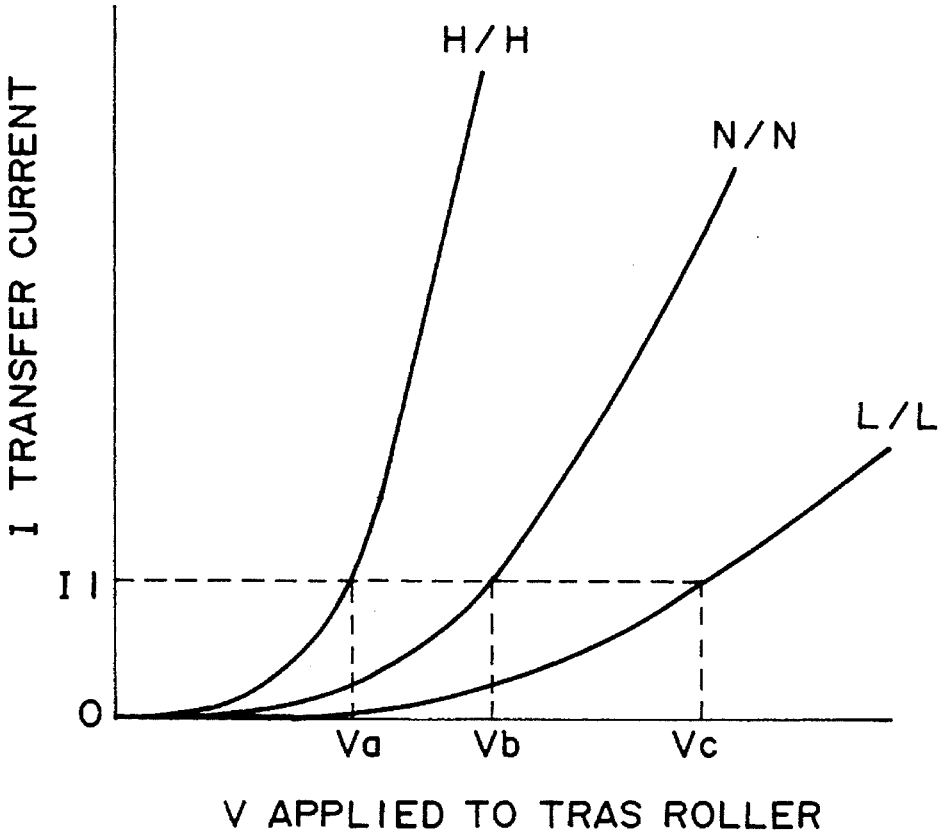
FIG. 9 is a graph of variation of V-I property due to change of ambient condition, of the transfer means.
Figure 10:
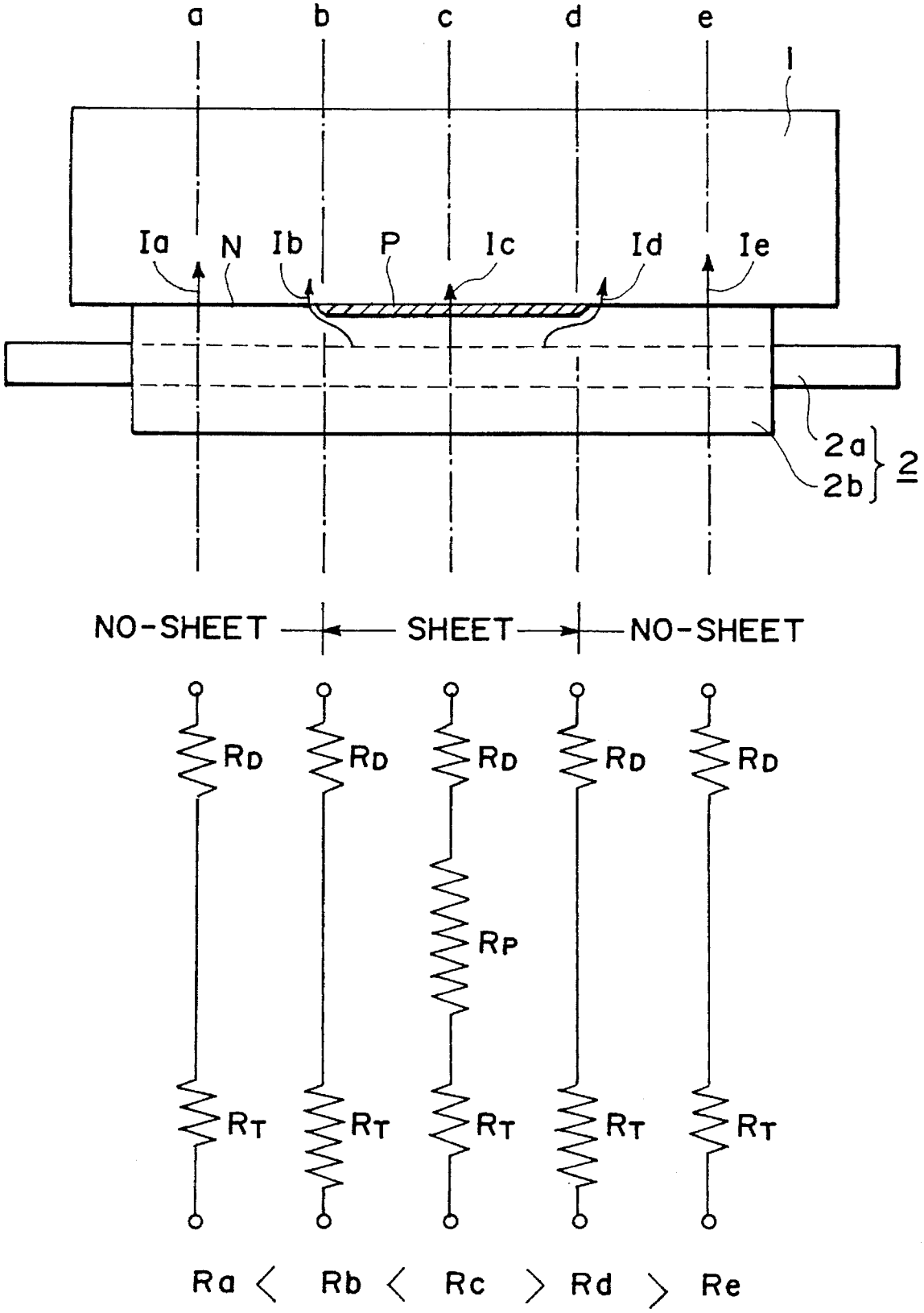
FIG. 10 illustrates transfer currents through a sheet passage portion and sheet non-passage portion, and equivalent circuit diagrams.

FIG. 9 shows the variation of the V-I characteristic due to the change of the ambient condition.

Figure 2:
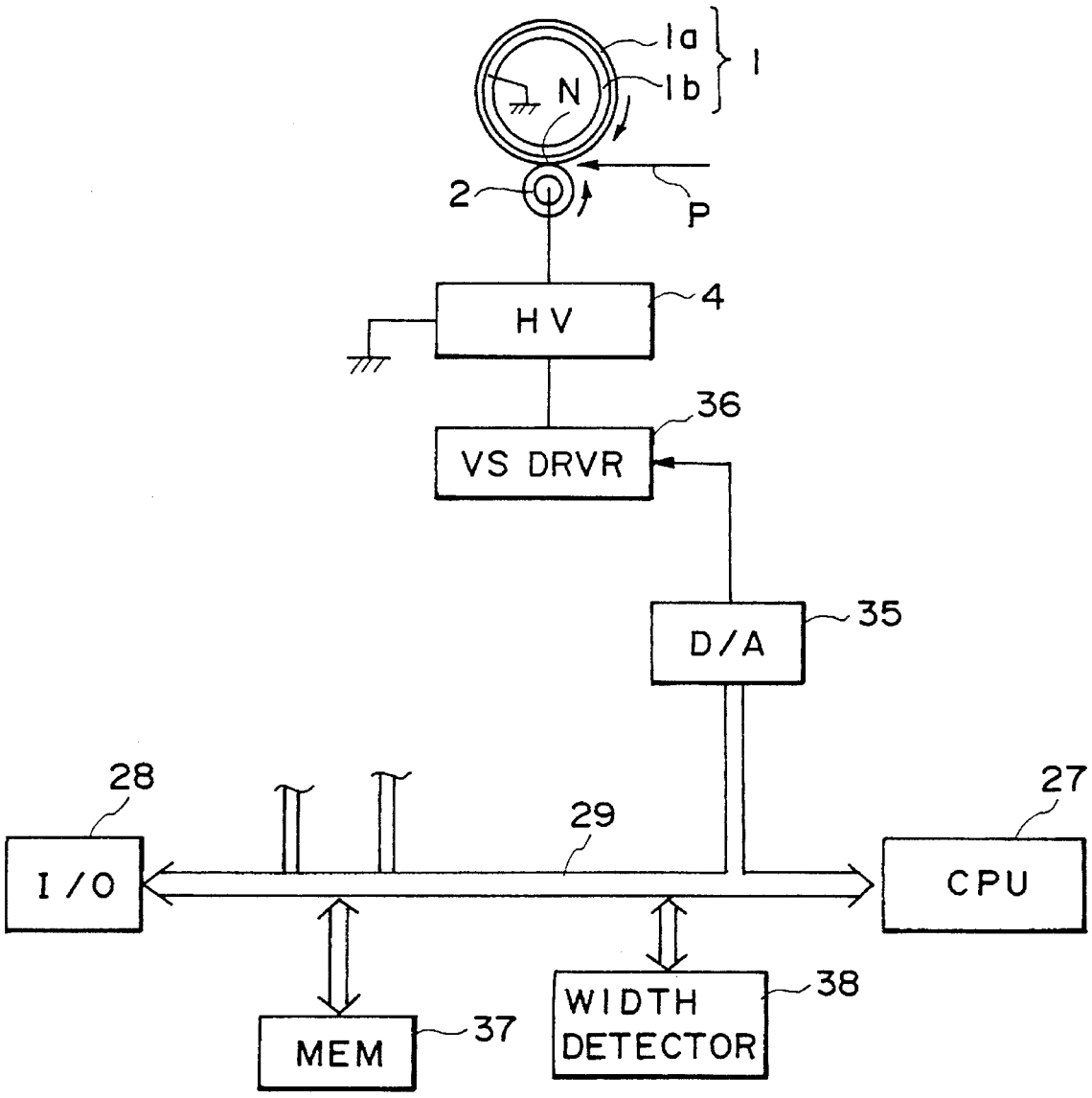
FIG. 2 is a block diagram of a control system.

FIG. 2 shows a bias voltage switching means for the transfer roller 2. A voltage source driving circuit 36 is connected through D/A converter 35 to a bus line 29 connecting I/O port 28 and CPU 27 of a microprocessor controlling The image forming apparatus. Optimum coefficients R have been determined on the basis of the process speed, the resistance of The image bearing member, the material and resistance of the transfer roller, the nip width of the transfer nip N, are stored in a memory 37.

During the non-transfer-operation until the transfer material P reaches the transfer nip N, the bias applied to the transfer roller 2 is constant-current-controlled so that the current flowing from the transfer roller 2 to the photosensitive member is constant. The voltage VM at this time (output voltage of the voltage source 4) is stored. As shown FIG. 3, upon the image transfer onto the maximum usable size of the transfer sheet, a voltage VH×R1 using linear equation L1 is applied to the transfer roller 2 when the transfer material P is in the transfer nip N (constant voltage control).

Upon the transfer of a smaller size, linear equations L2 or L3 is selected in accordance with the signal from the transfer material width detecting means, and the voltage applied during the transfer operation is made larger than in the transfer onto the transfer material of the maximum size. In this case, the applied voltage increases with decrease transfer material. For example, assuming that the maximum usable size of the image forming apparatus is A3, the linear equation L1 is used for A3 size transfer material, and linear equation L2 is used for B4 size, and L3 is used for the transfer material such as post card.

As a means for detecting a width of the transfer material, different sheet feeding cassettes in accordance with the sizes of the transfer material, are used, and projections corresponding to the sizes of the transfer materials are provided for the cassettes, in which the signal is obtained from the projections of the cassettes 17. In an image forming apparatus having a manual feeding tray, the information may be obtained from the position of the manual feeding guide.

In place of detecting means for the width of the transfer material, means may be provided on an operation panel to designate the size of the transfer material to permit the image forming apparatus notifies the width of the transfer material. The level of the constant voltage may be determined in accordance with an output of the designating means.

By controlling the transfer bias of the transfer means, the transfer current can be controlled to the optimum level irrespective of the ambience and the size of the transfer material. As a result, stabilized good images can be produced always.

Figure 3:
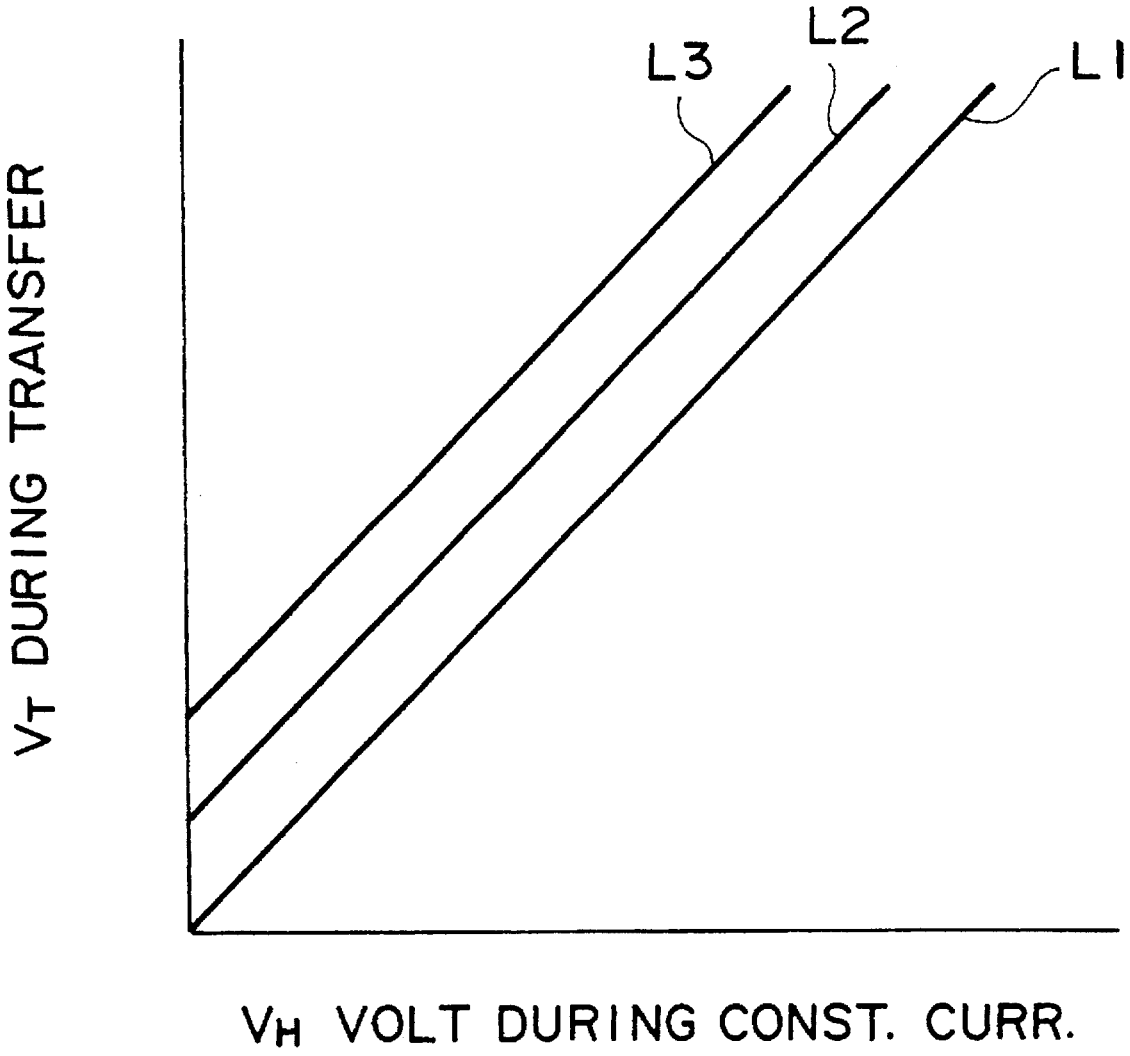
FIG. 3 is a graph of controlling equation, according to Embodiment 1 of the present invention.

Embodiments 2–5 will be described in which the voltage VT applied to the transfer roller during the transfer operation is calculated on the basis of the stored voltage VM in the manner different from that shown in FIG. 3 (Embodiment 1).

The apparatus shown in FIG. 1, and the control block diagram in FIG. 2, are commonly usable in Embodiments 2–5.

EMBODIMENT 2 (FIG. 4)

Figure 4:
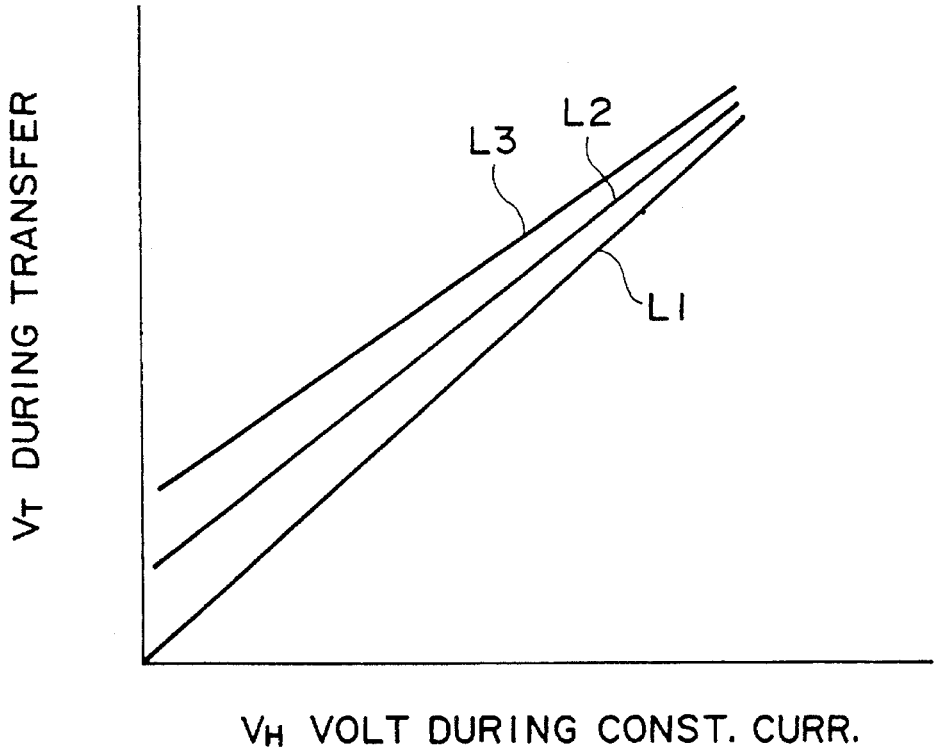
FIG. 4 is a graph of controlling equation according to Embodiment 2.

In this embodiment, the coefficient for calculating the transferring voltage VT is calculated on the basis of the stored voltage VH, is as shown in FIG. 4.

In this case, the increment of the transferring voltage increases with decrease of the stored voltage. As described hereinbefore, the leakage of the transfer current from the sheet-passage portion to the non-sheet-passage portion increases with decrease of the resistance of the transfer roller. Therefore, the increment of the transferring voltage for the correction is more effective when the resistance of the transfer roller is lower, that is, when the stored voltage VH is lower.

EMBODIMENT 3 (FIG. 5)

Figure 5:
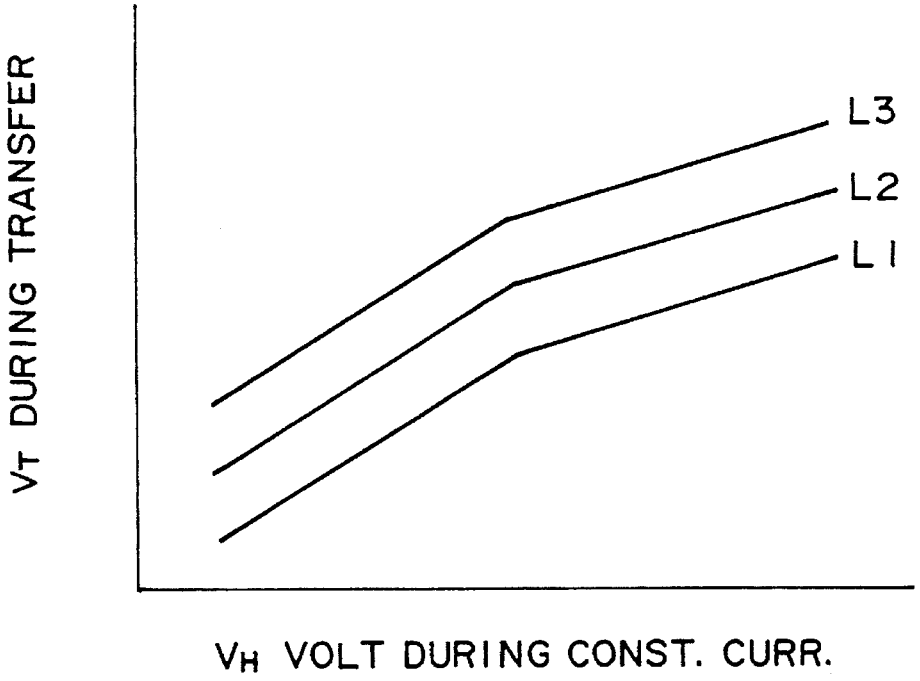
FIG. 5 is a graph of controlling equation according to Embodiment 3.

In this embodiment, as shown in FIG. 5, the coefficient is dependent on the stored voltage VH as shown in L1, L2 and L3 in this Figure.

In FIG. 5, the equation is not rectilinear. The required transferring current is different if the ambient condition such as temperature or humidity is different. Accordingly, in order to provide the proper transfer current under any ambient condition, the coefficients R1, R2 and R3 are preferably changed depending on the stored voltage VH.

In this case, the equations L1, L2 and L3 are curved, strictly speaking. Here, for the purpose of simplicity, they represent two linear lines cover and the control is effected such that L1, L2 and L3 are parallel with each other.

EMBODIMENT 4 (FIG. 6)

Figure 6:
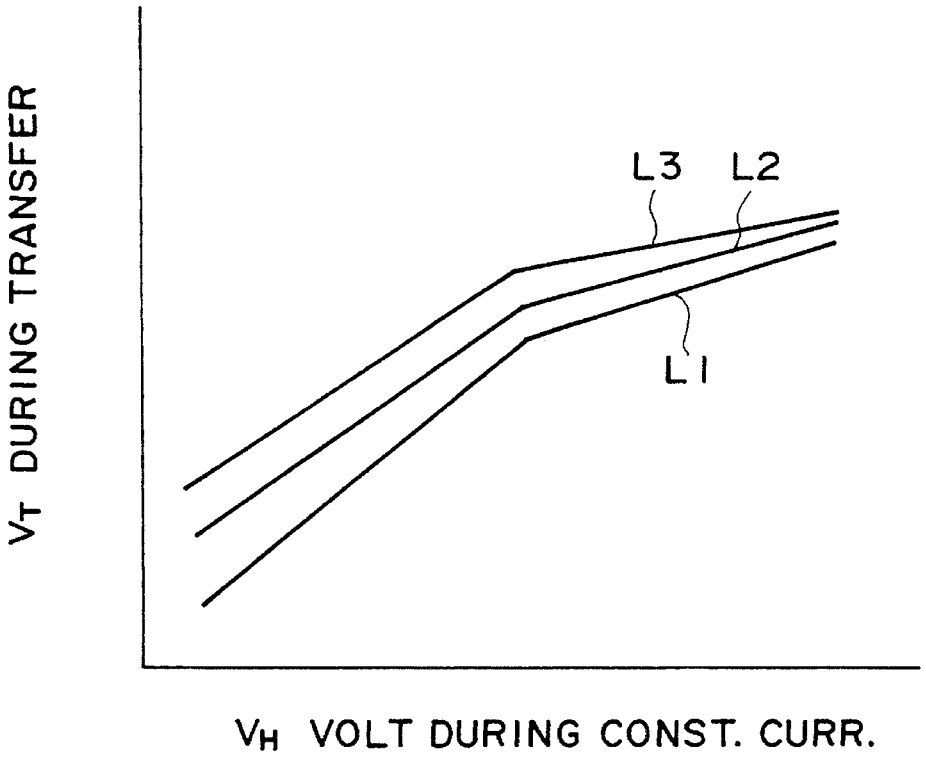
FIG. 6 is a graph of controlling equation according to Embodiment 4.

In this embodiment, as shown in FIG. 6, the coefficient R is dependent on the stored voltage VH as in Embodiment 3, and the relations among L1, L2 and L3 are not parallel.

The coefficient R, namely, L1, L2 and L3 are set so as to provide optimum transfer currents for any widths of the transfer material.

In this embodiment, the coefficient is approximated by two rectilinear lines, and are independently set depending on the width of the transfer material. Therefore, more proper transfer current control is possible, and therefore, good images can be produced.

Since the relation is approximated by two lines, the conversion of the transferring voltage from the stored voltage V1 is simple.

EMBODIMENT 5 (FIG. 7)

Figure 7:
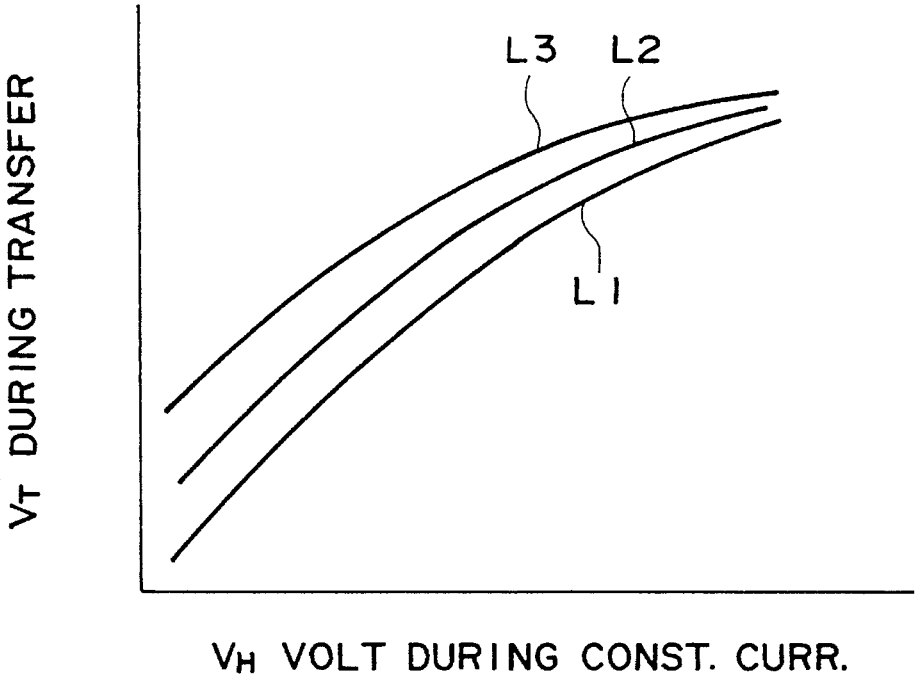
FIG. 7 is a graph of controlling equation according to Embodiment 5.
Figure 8:
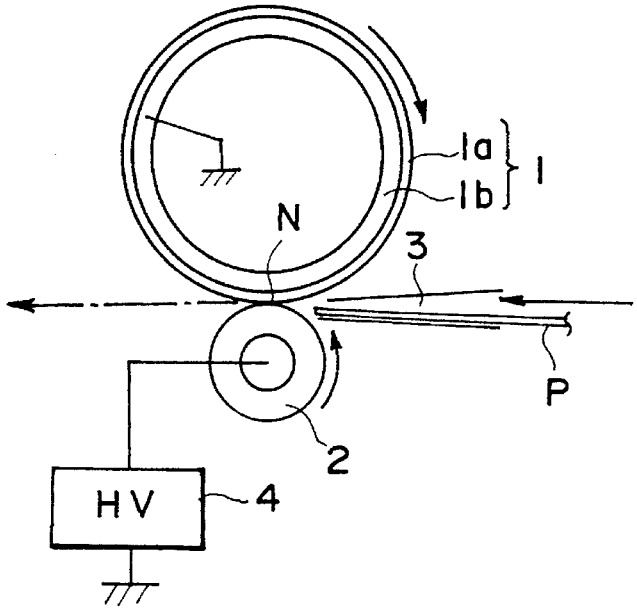
FIG. 8 schematically shows an example of a contact type elecrostatic transfer means.

As shown in FIG. 7, the coefficients R1, R2 and R3 are dependent on the stored voltage VH, and the relations L1, L2 and L3 are independently set. Additionally, they are continuous, so that the optimum transfer current control is possible irrespective of the size of the transfer material or the ambient condition, and therefore, good images can be produced always.

As a method of conversion, conversion table is prepared in the memory. When the stored voltage VH is obtained during the constant current control operation, the voltage VT is produced corresponding thereto.

In Embodiments 1–5, the constant current control is effected such that a constant current flows through the transfer roller when the transfer material is absent from the transfer nip, and the voltage applied to the transfer roller 2 at this time is stored as information content A, which is multiplied by a predetermined coefficient R to determine the voltage to be applied during the transfer operation. However, the bias voltage applied to the transfer roller during the non-transfer-operation, is not necessarily controlled for the constant current. As shown in U.S. Pat. No. 5179397, a constant voltage control is carried out during the non-transfer-operation, and the current at this time is used as the information content, on the basis of which the voltage applied to the transfer roller during the transfer operation may be determined.

In the foregoing, the transfer means has been described as a transfer roller, but it is not limiting, and it may be in the form of a transfer belt, blade, blush or the like.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a movable image bearing member:

an image transfer member cooperative with said image bearing member to form a nip where an image is transferred from said image bearing member onto a transfer material, wherein said transfer member is constant-voltage-controlled during image transfer operation;

wherein a voltage applied to said transfer member during constant voltage control is determined in accordance with a dimension of the transfer material measured in a direction perpendicular to a movement direction of said image bearing member.

2. An apparatus according to claim 1, wherein said transfer member is constant-current-controlled when an image transfer operation is not carried out, and the voltage during image transfer operation is determined on the basis of a voltage A applied to said transfer member when the transfer member is constant-current-controlled.

3. An apparatus according to claim 2, in the constant current control, a constant current flows from said transfer member to said image bearing member.

4. An apparatus according to claim 1, wherein said transfer member is constant-voltage-controlled when an image transfer operation is not carried out, and the voltage during image transfer operation is determined on the basis of a current A flowing through said transfer member when the constant voltage control is carried out when the image transfer operation is not carried out.

5. An apparatus according to claim 1, wherein the voltage during image transfer operation increases with decrease of the dimension.

6. An apparatus according to claim 2, wherein the voltage during image transfer operation is determined by multiplying the voltage A by e predetermined coefficient R, and wherein the coefficient R is variable in accordance with the dimension.

7. An apparatus according to claim 4, wherein the voltage during image transfer operation is determined by multiplying the current A by a predetermined coefficient R, and wherein the coefficient R is variable in accordance with the dimension.

8. An apparatus according to claim 6, wherein the coefficient R is variable in accordance with the voltage A.

9. An apparatus according to claim 7, wherein the coefficient R is variable in accordance with the current A.

10. An apparatus according to claim 1, wherein said transfer member is in the form of a roller.

11. An apparatus according to claim 1 or 10, wherein said transfer member is contactable to said image bearing member.

12. An apparatus according to claim 1, further comprising means for detecting a size of the transfer material.

* * * * *

UNITED STATES PATENT AND TRADEMARK OFFICE

CERTIFICATE OF CORRECTION

PATENT NO. : 5,530,522

DATED : June 25, 1996

INVENTOR(S) : TAKEO TSUNEMI

It is certified that error appears in the above-indentified patent and that said Letters Patent is hereby corrected as shown below:

On the title page;

item [57] ABSTRACT, line 8, "during" should read --during the--.

Column 1, line 14, "member," should read --member, or--;

line 16, "process," should read --process, or--;

line 17, "to" should read --to the--; and line 22, "apparatus," should read --apparatus, an--, and "roller" should read --roller, a--.

Column 2, line 5, "deviation" should read --deviations--;

line 7, "from" should read --from the--;

line 10, "since" should be deleted, and "or" should read --or an--;

line 12, "exist," should read --exist.--;

line 15, "arise." should read --arises.--;

line 19, "used," should read --used, a--;

line 24, "current" should read --current more--;

line 27, "the" should be deleted;

line 47, "used," should read --used, a--; and line 52, "current" should read --current more--.

Column 3, line 10, "flows" should read --flows through the--; and line 43, "during" should read --during the--.

UNITED STATES PATENT AND TRADEMARK OFFICE

CERTIFICATE OF CORRECTION

PATENT NO. : 5,530,522
DATED : June 25, 1996
INVENTOR(S) : TAKEO TSUNEMI

It is certified that error appears in the above-indentified patent and that said Letters Patent is hereby corrected as shown below:

Column 4,
line 2, "elecrostatic" should read --electrostatic--; and
line 55, "effected" should read --effected on--.

Column 5,
line 2, "with" should read --in a--;
line 10, "a" should be deleted;
line 13, "36." should read --26.--;
line 26, "e," should read --e, and--; and
line 60, "then" should read --than--.

Column 6,
line 5, "The" should read --the--;
line 7, "The" should read --the--;
line 14, "VM" should read --VH--;
line 15, "shown" should read --shown in--;
line 26, "decrease" should read --decrease of the--;
line 54, "VM" should read --VH--; and
line 64, "is" should be deleted.

UNITED STATES PATENT AND TRADEMARK OFFICE

CERTIFICATE OF CORRECTION

PATENT NO. : 5,530,522

DATED : June 25, 1996

INVENTOR(S) : TAKEO TSUNEMI

It is certified that error appears in the above-indentified patent and that said Letters Patent is hereby corrected as shown below:

Column 8 line 32, "2," should read --2, wherein--;
line 47, "e" should read --a--.

Signed and Sealed this

Nineteenth Day of November, 1996

*Attest:*

Bruce Lehman

BRUCE LEHMAN

*Attesting Officer*

*Commissioner of Patents and Trademarks*